United States Patent [19]

O'Day

[11] 4,282,611

[45] Aug. 11, 1981

[54] SANITARY URINAL

[76] Inventor: Gerald L. O'Day, 24160 McDonald, Dearborn Heights, Mich. 48125

[21] Appl. No.: 167,616

[22] Filed: Jul. 11, 1980

[51] Int. Cl.[3] ..... A47K 11/00

[52] U.S. Cl. ..... 4/144.1; 4/301; 4/144.4; 4/DIG. 5

[58] Field of Search ..... 4/144.1, 144.4, 114.1, 4/462, 341, 454, DIG. 5, 237, 301, 447

[56] References Cited

U.S. PATENT DOCUMENTS

| | | | |
|---|---|---|---|
| 485,960 | 11/1892 | Martin | 4/144.4 |
| 2,568,857 | 9/1951 | Jacobs | 4/341 |
| 3,412,408 | 11/1968 | Michal, Jr. | 4/341 |
| 3,500,480 | 3/1970 | Michal, Jr. | 4/341 X |
| 3,570,015 | 3/1971 | Rosengaus | 4/447 |
| 3,822,419 | 7/1974 | Wilson, Jr. | 4/144.4 |
| 4,041,553 | 8/1977 | Sussman | 4/447 |
| 4,145,768 | 3/1979 | Chevrette | 4/144.1 |

*Primary Examiner*—Henry K. Artis

*Attorney, Agent, or Firm*—Cullen, Sloman, Cantor, Grauer, Scott & Rutherford

[57] ABSTRACT

A urinal adapted for attachment to a toilet bowl has an apertured bracket arm connected to the seat anchor bolts and extends laterally of the toilet bowl. A swing arm is pivotally connected to the bracket arm and supports a funnel, which has a non-use position and is adapted for movement into registry with said bowl.

13 Claims, 8 Drawing Figures

FIG. 1
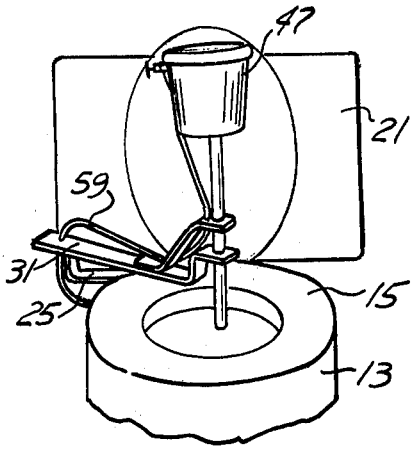
FIG. 2
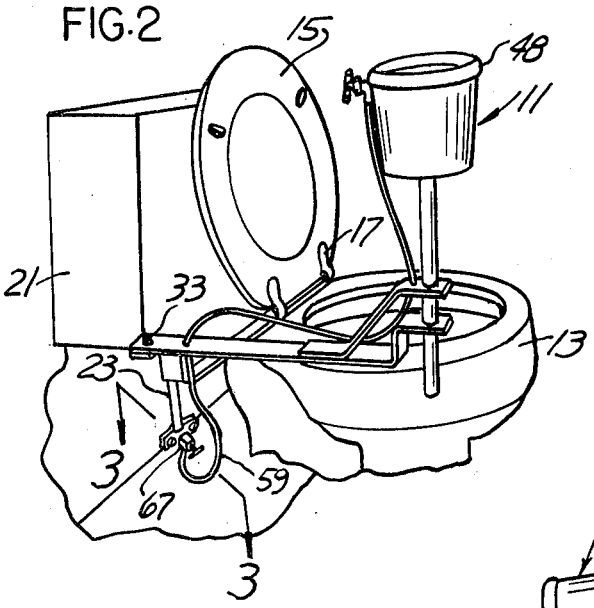
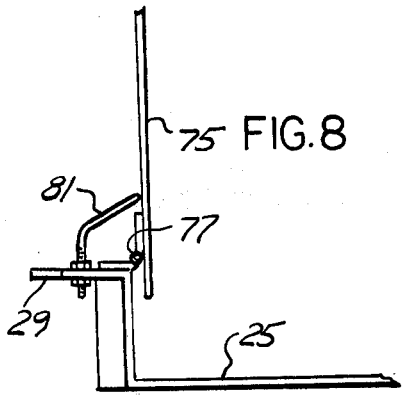
FIG. 8
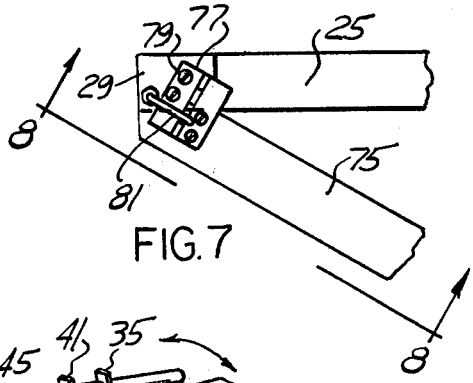
FIG. 7
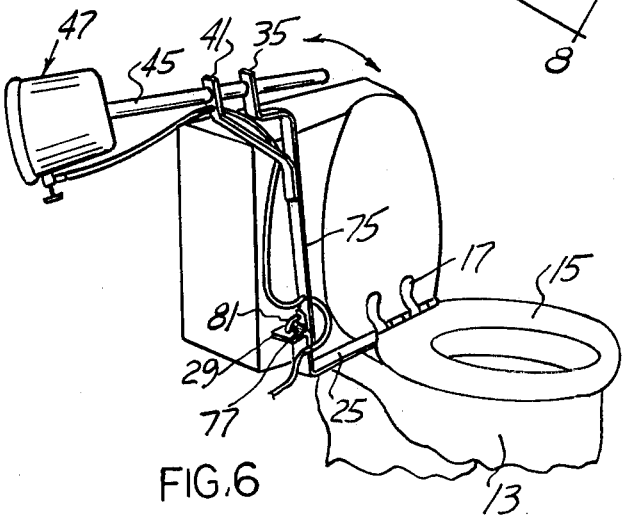
FIG. 6
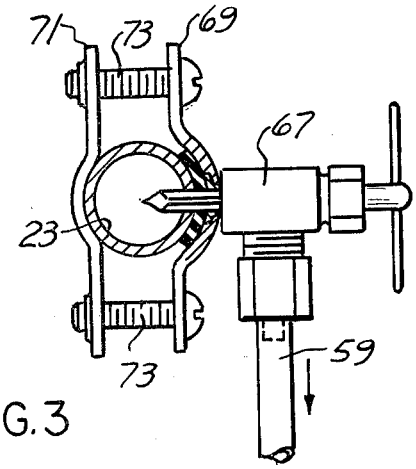
FIG. 3

SANITARY URINAL

BACKGROUND OF THE INVENTION

Under some circumstances, handicapped persons and senior citizens may have some difficulties in the use of the conventional toilet bowl. Often, the toilet bowl is at an inconvenient height and location such as to cause a problem to such person standing adjacent the toilet bowl.

THE PRIOR ART

A urinal attachment for a toilet bowl is known such as shown in the U.S. Pat. No. 3,500,480, of March, 1970. Other toilet attachments or related urinal devices are shown in one or more of the following additional U.S. Pat. Nos.:

| | |
|---|---|
| 363,494: | White |
| 1,642,255: | Lowenstein |
| 2,243,791: | Botenstein |
| 3,822,419: | Charles Kenneth Wilson, Sr. |
| 405,014: | British Patent |

SUMMARY OF THE INVENTION

An important feature of the present invention is directed to sanitary urinal which is adapted for attachment to a toilet bowl, which has a nonuse position laterally of the toilet bowl and which may be rotated in to registry with the toilet bowl.

It is a further feature to provide a bracket arm for the sanitary urinal which is apertured in order to receive the conventional seat anchor bolts so that said arm is fixedly secured to the toilet bowl and projects laterally thereof.

It is a further feature to provide a swing arm which at one end is pivotally or hingedly connected to the bracket arm, in such manner that when the urinal is not in use, the funnel and its depending stem forming a part thereof, is swung to a position out of registry with the toilet bowl and wherein the swing arm may be rotated relative to the bracket arm so as to bring the funnel into registry with the toilet bowl.

A further feature incorporates the application of flexible conduit, at one end connected to a hand valve on the funnel and its other end connected into a conventional water line for rinsing of the funnel as desired.

A further feature incorporates into the flexible conduit for rinsing the funnel, the pierce type of valve bracket assembly for application and securing to a water pipe including a manual valve element to automatically pierce the water pipe for providing fluid communication to the flexible conduit.

These and other objects will be seen from the flowing specification and claims in conjunction with the appended drawings.

THE DRAWINGS

FIG. 1 is a front perspective view of the present sanitary urinal arranged in a use position with respect to a toilet bowl fragmentarily shown.

FIG. 2 is a side perspective view thereof showing the sanitary urinal displaced out of registry with the toilet bowl.

FIG. 3 is a fragmentary section taken in the direction of arrows 3—3 of FIG. 2 illustrating the connection of a rinse conduit to a hand valve to a water pipe.

FIG. 6 is a side perspective view of a modified sanitary urinal.

FIG. 7 is a fragmentary plan view of the swing arm thereof as hingedly connected to the bracket arm.

FIG. 8 is a fragmentary side elevational view of the modified urinal attachment shown in FIG. 6.

It will be understood that the above drawings illustrate merely several preferred embodiments of the invention, and that other embodiments are contemplated within the scope of the claims hereafter set forth.

DETAILED DESCRIPTION OF AN EMBODIMENT OF THE INVENTION

Figure 4:
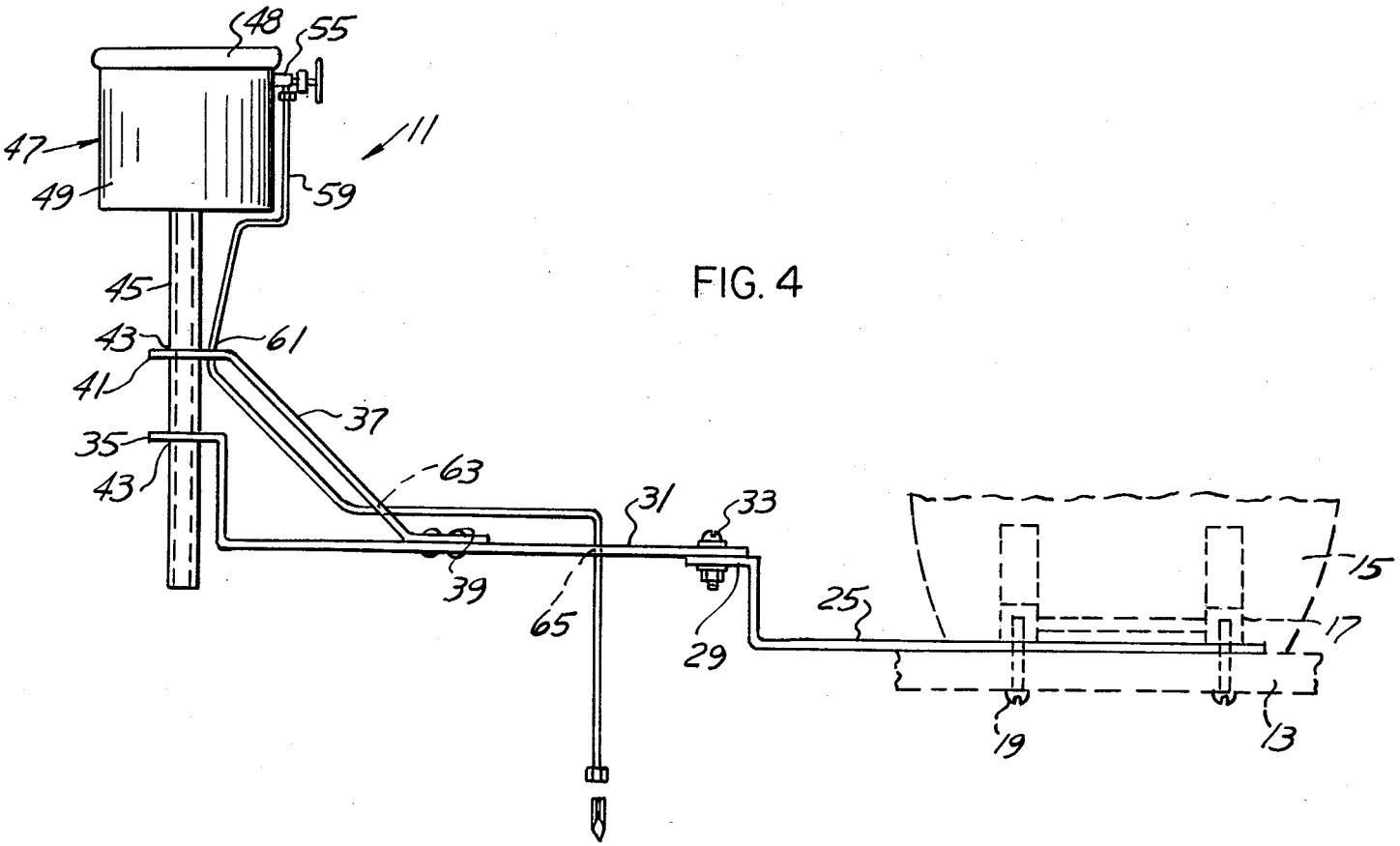
FIG. 4 is a side elevational view of a sanitary urinal as mounted upon a toilet bowl fragmentarily shown.

A sanitary urinal is generally indicated at 11 as mounted upon a toilet bowl 13, fragmentarily shown, and which includes a conventional seat 15 with conventional anchor hinge 17 anchored upon rear portions of the toilet bowl as by the up-standing bolts 19 shown in FIG. 4.

A conventional water tank is shown at 21 usually mounted upon or adjacent to a wall having a conventional water supply pipe 23 connected thereto such as shown in FIG. 3.

The present sanitary urinal includes an elongated bracket arm 25 having a pair of spaced apertures 27 adjacent one end thereof adapted for registry over the conventional bolts 19 and secured thereto by the same fastener conventionally employed for anchoring the seat hinge 17 upon the toilet bowl 13 as fragmentarily shown in FIG. 4.

The other end of arm 25 has an apertured vertical offset 29 which supportably receives one end of swing arm 31 connected thereto by the pivot bolt 33.

The other end of the swing arm 31 has an apertured vertical offset 35. Formed bracket 37 overlies swing arm 31, is inclined at an acute angle thereto and at one end bears against and is secured to said swing arm as by fasteners 39. Its other end has a vertical offset 41 in registry with swing arm vertical offset 35. Both of these offsets are apertured at 43 and cooperatively and supportably receive the drain stem 45 which depends from the funnel 47.

Figure 5:
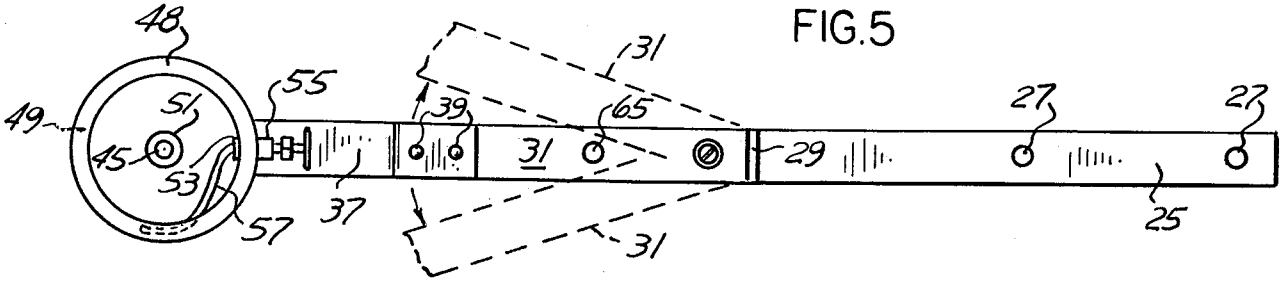
FIG. 5 is a plan view thereof.

Said funnel has an annular rim 48 arcuate in cross-section FIG. 5 and an adjacent circular side wall 49. Its bottom wall includes a drain 51 in communication with and receiving the upper end of stem 45.

An apertured fitting 53 is secured to said funnel side wall and projects therethrough, and connected thereto is a conventional hand operated rinse valve 55 which outlets to the interior of said funnel and into the arcuate rinse tube 57. Tube 57 is nested within said rim and extends along a portion thereof outletting upon the interior of said funnel.

The flexible conduit 59, preferably plastic and preferably clear, at one end is connected to the rinse valve 55, is loosely and supportably threaded through apertures 61 and 63 formed through bracket 37 and an additional aperture 65 formed through swing arm 31. Said conduit extends to and is connected to the saddle valve 67 shown in FIG. 3. Said saddle valve is a conventional manually operative valve which includes mount bracket 69 secured thereto and shaped so as to cooperatively bear against and seal over one side of the water supply pipe 23. Mount bracket 69 is anchored with respect to said pipe by the parallel transverse spanner 71 which engages said pipe on the other side thereof and is fixedly secured thereto by fasteners 73 in a conventional manner.

The hand valve 67 has a conventional piercing stem so that upon initial rotation thereof, it automatically projects into water supply pipe 23 providing water pressure communication to the conduit 59 when valve 67 has been manually opened.

Accordingly with the present sanitary urinal adjustably and swingably mounted upon the toilet bowl such as shown in FIGS. 1 and 2 and with the valve opened, fluid communication under pressure is made through the flexible conduit 59 up to the hand valve 55 upon the funnel.

After the funnel has been used such as in the position thereof shown in FIG. 1, the hand valve 55 may be temporarily opened so that rinsing water may be delivered to the interior of said funnel.

As shown in FIG. 1 the funnel and associated stem 45 has a use position in substantial registry with the toilet bowl 13 and when not in use may be swung laterally such as to the offset position shown in FIG. 2. Here the swing arm 31 has been rotated about its pivot 33 to any convenient position. In such position the toilet bowl and seat 15 may be used in a conventional manner.

The construction and arrangement of the sanitary urinal and the mounting brackets therefore is such that it may be swung into its use position in registry with the toilet bowl even with the seat 15 lowered. The sanitary urinal may be used however, with the seat pivoted upwardly as shown in FIG. 2.

A modified swing arm 75 is shown in FIGS. 6, 7 and 8 and wherein instead of the conventional pivotal mounting 33 of the swing arm FIG. 4, the swing arm 75 FIG. 6, is hinged as at 77 to the bracket arm 25 as by fasteners 79.

Accordingly instead of the swing arm rotating in a horizontal plane as in FIGS. 1 and 2, the modified swing arm 75 in a non-use position has been swung in a vertical plane to the position shown in FIG. 6. By this construction, the swing arm 75 in its use position, extends at an acute angle with respect to the bracket arm 25 fragmentarily shown in FIG. 7.

Adjustable stop 81 is affixed to bracket arm offset 29 as in FIGS. 6, 7 and 8 limits upward pivotal movement of the hinged swing arm 75 to the position shown in FIGS. 6 and 8.

The present sanitary urinal is of a very simple construction and wherein the bracket arm 25 is affixed to the toilet bowl by using the conventional seat anchoring bolts 19 in FIG. 4. Therefore the bracket arm 25 and its offset 29 is rigidly secured to the toilet bowl and projects laterally thereof a short distance. The swing arm 31 of FIG. 4 is generally parallel to bracket arm 25 and supports at its outer end by the spaced offsets 35 and 41, the stem 45 of funnel 47.

Having described my invention, reference should now be had to the following claims; I claim:

1. A sanitary urinal adapted for attachment to a toilet bowl having a pair of seat anchor bolts;

a bracket arm apertured at one end to receive said bolts for securing said arm to said bowl, with its other end extending laterally thereof;

a swing arm at one end pivotally connected to and supported upon said other end of said bracket arm;

a funnel having an elongated depending drain stem overlying said arm with its stem adjustably secured to the other end of said swing arm;

said swing arm and funnel having a non-use position and adapted for movement relative to said bracket arm for registry of said drain stem with said bowl.

2. In the urinal of claim 1, a seat overlying said bowl and bracket arm and having a hinge assembly connected to said bowl.

3. In the urinal of claim 2, said hinge assembly being connected to said bolts.

4. In the urinal of claim 1, a water tank above said bowl, including a water supply pipe connected thereto;

a manually controlled rinse valve on and outletting into said funnel;

and a flexible conduit at one end connected to said rinse valve and at its other end connected to said water supply pipe.

5. In the urinal of claim 4, the connection of said conduit to said water pipe including a hand valve mounted on and connected into said water pipe and having an inlet connected to said conduit.

6. In the urinal of claim 1, said swing arm when in its non-use position being in a plane parallel to said bracket arm with said funnel displaced laterally of said toilet bowl.

7. In the urinal of claim 1, the pivot connection of said swing arm to said bracket arm including a hinge whereby said swing arm when in a non-use position is in a plane on an acute angle to said bracket arm, and said funnel is rotated 90° approximately;

said swing arm when in its use position extending at an acute angle to said bracket arm.

8. In the urinal of claim 1, an adjustable stop on said bracket arm engageable with said swing arm.

9. In the urinal of claim 1, said other end of said bracket arm having a vertical offset supporting said swing arm.

10. In the urinal of claim 9, said other end of said swing arm having an apertured vertical offset receiving said funnel stem.

11. In the urinal of claim 10, and a bracket mounted on and overlying said swing arm having an apertured vertical offset spaced from said swing arm offset cooperatively receiving and supporting said funnel stem.

12. In the urinal of claim 11, said swing arm bracket and swing arm being apertured to supportably receive said conduit.

13. In the urinal of claim 4, said funnel having an annular rim of arcuate cross-section;

and a rinse tube nested within said rim extending along a portion thereof, and one end connected to said rinse valve.

* * * * *